US005456287A

United States Patent [19]

Leu

[11] Patent Number: 5,456,287

[45] Date of Patent: Oct. 10, 1995

[54] COMPRESSOR/VACUUM PUMP REED VALVE

[75] Inventor: Shawn A. Leu, Sheboygan, Wis.

[73] Assignee: Thomas Industries Inc., Sheboygan, Wis.

[21] Appl. No.: 317,967

[22] Filed: Oct. 3, 1994

[51] Int. Cl.[6] ..... F16K 15/16

[52] U.S. Cl. ..... 137/855; 417/571

[58] Field of Search ..... 137/855–858; 417/569, 571

[56] References Cited

U.S. PATENT DOCUMENTS

| | | | |
|---|---|---|---|
| 2,671,434 | 3/1954 | Schmiedeskamp . | |
| 2,908,287 | 10/1959 | Augustin . | |
| 3,314,600 | 4/1967 | Hadley . | |
| 3,568,712 | 3/1971 | Rinehart | 137/525.3 |
| 3,679,333 | 7/1972 | Zoppi | 417/571 |
| 3,998,571 | 12/1976 | Falke . | |
| 4,065,237 | 12/1977 | Webb | 417/503 |
| 4,193,424 | 3/1980 | Hrabal | 137/855 |
| 4,437,490 | 3/1984 | Demers et al. | 137/512.4 |
| 4,573,888 | 3/1986 | Kitchin | 417/560 |
| 4,642,037 | 2/1987 | Fritchman | 417/571 |
| 4,730,550 | 3/1988 | Bramstedt et al. | 92/240 |
| 4,886,093 | 12/1989 | Itakura et al. | 137/855 |
| 5,016,669 | 5/1991 | Jamieson | 137/512 |
| 5,062,779 | 11/1991 | Da Costa | 418/270 |
| 5,100,306 | 3/1992 | Moran, Jr. et al. | 417/571 |
| 5,140,748 | 8/1992 | Kandpal | 29/890.13 |
| 5,171,137 | 12/1992 | Todescat et al. | 417/571 |
| 5,173,040 | 12/1992 | Yamazawa et al. | 417/571 |
| 5,178,183 | 1/1993 | Kim | 137/527 |
| 5,192,200 | 3/1993 | Lilie et al. | 417/566 |
| 5,197,867 | 3/1993 | Kandpal | 417/571 |
| 5,209,260 | 5/1993 | Baek | 137/527 |
| 5,213,125 | 5/1993 | Leu | 137/15 |
| 5,226,796 | 7/1993 | Okamoto et al. | 417/571 |
| 5,244,363 | 9/1993 | Olson | 417/490 |
| 5,265,646 | 11/1993 | Richardson | 137/856 |
| 5,266,016 | 11/1993 | Kandpal | 417/569 |
| 5,327,932 | 7/1994 | Rozek | 137/512 |

*Primary Examiner*—Robert G. Nilson
*Attorney, Agent, or Firm*—Quarles & Brady

[57] ABSTRACT

Intake or exhaust reed valves of a compressor or vacuum pump have T-shaped flappers which are received in similarly T-shaped pockets so as to be substantially flush with the valve plate. A dirt trap groove is formed in each pocket adjacent to the hinge line of the flapper, a corner relief groove surrounds lands which support the flappers in their associated pockets above the groove, and the extending-part of each pocket widens in the direction away from the cross-part of the pocket. The mating T-shapes of a flapper in a pocket restrain the flapper in the pocket without interfering with the opening and closing motion of the flapper.

9 Claims, 4 Drawing Sheets

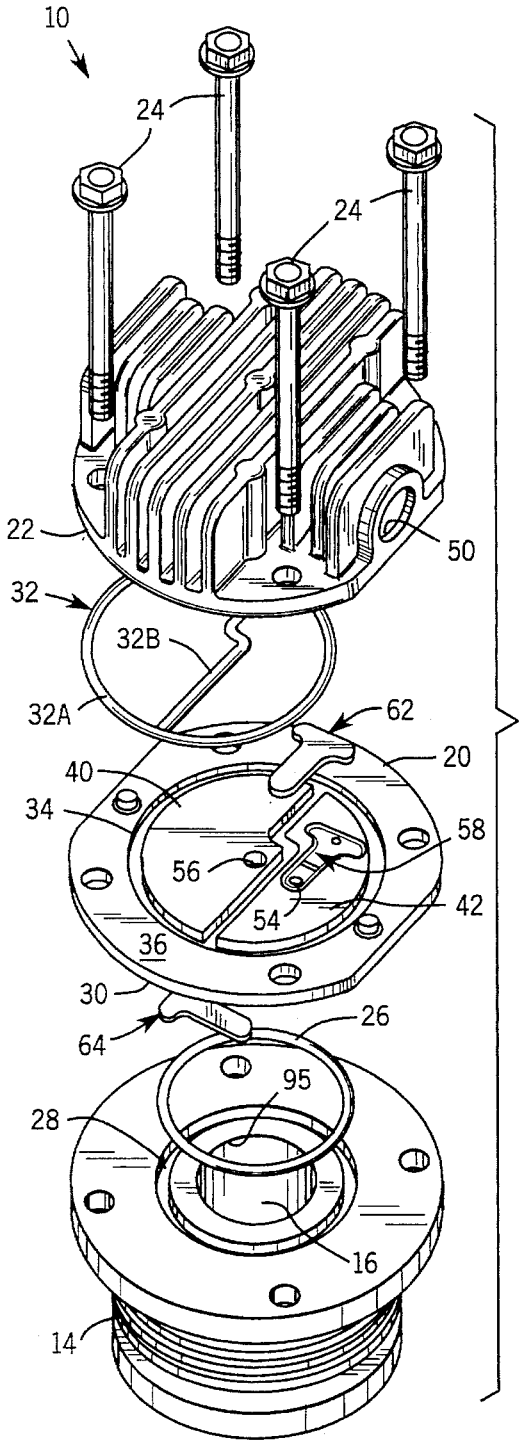
FIG. 1
FIG. 2
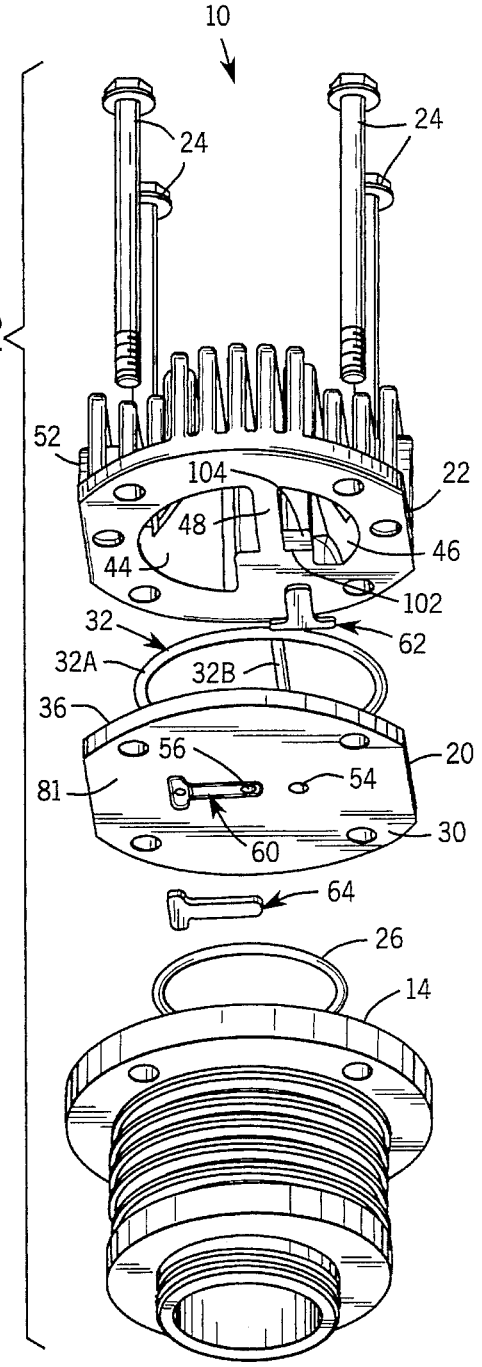

COMPRESSOR/VACUUM PUMP REED VALVE

BACKGROUND OF THE INVENTION

1. Field of the Invention

This invention relates to reed valves for compressors and vacuum pumps.

2. Discussion of the Prior Art

Reed valves for vacuum pumps and compressors, collectively referred to herein as pumps, are well known. These valves typically include a thin reed or flapper which opens or closes in response to a pressure difference across it. For intake reed valves, this allows for the intake of gas (typically air) to the working chamber on the intake stroke of the pump, and for an exhaust reed valve, the expulsion of gas from the working chamber on the exhaust stroke, during the pumping process.

Prior designs in general had a valve plate with an intake port and an exhaust port bored through it provided between the working chamber and a head of the pump. An intake flapper was provided over the intake port on the working chamber side of the plate and an exhaust flapper was provided over the exhaust port on the head side of the plate. Fasteners were typically used to secure both valve flappers to the valve plate.

For both valve flappers, the fasteners required extra steps in assembly, for example, boring and tapping holes, threading and tightening screws, etc. In addition, for the intake flapper on the working chamber side of the valve plate, fasteners required a clearance volume, to avoid interference with the piston, which detracted from the swept volume in the working chamber and therefore detracted from the pumping efficiency with which the unit could be operated.

In other arrangements, the intake and discharge flappers were formed in one piece and laid in the same or nearly the same plane. With these arrangements, a substantial clearance volume also existed adjacent to the intake flapper. Therefore, a need exists for a reed valve which is easy to assemble, inexpensive and reliable, and in particular for an intake reed valve having these advantages and which also helps reduce the clearance volume in the working chamber.

SUMMARY OF THE INVENTION

The invention provides a reed valve for a compressor or vacuum pump which overcomes the above disadvantages. In a reed valve of the invention, the valve flapper is generally T-shaped, having a cross-part and an extending-part extending from the cross-part. The valve flapper is received in a similarly T-shaped valve pocket which has a cross-part and an extending-part extending from the cross-part and surrounding the to be opened and closed. The flapper is received in the pocket with its extending part over the port and with its outer surface substantially flush with surfaces of the valve plate surrounding the pocket. The cross-part of the flapper is trapped in the cross-part of the pocket between the valve plate and another component of the pump to which the valve plate is attached.

This construction secures the flapper without any separate fasteners or fastener procedures in assembly, using the clamping of the valve plate to the other components of the pump, such as the cylinder in the case of an intake valve or the head in the case of an exhaust valve. The trapping of the cross-part of the flapper in the cross-part of the pocket restrains the flapper from longitudinal, lateral and angular motion, and locates the extending-part in the extending-part of the pocket so that the flapper can open and close freely over the port being controlled.

In one useful aspect of the invention, the pocket is defined by a peripheral corner relief groove which extends around the inside of the pocket at a base surface thereof so that the flapper is supported on one or more lands above the groove. Since the corner relief groove is below the flapper, the flapper edges do not interfere with or become bound by the corner radius at the bottom of the groove, as may be the case if the groove were not provided and the flapper seated against the bottom of the pocket where the sidewalls of the pocket intersect the bottom wall of the pocket.

In addition, the extending-part of the pocket preferably widens in the direction away from the cross-part so as to provide clearance with the flapper from the cross-part to the free end of the extending-part of the pocket. Preferably, the peripheral clearance between the cross-part of the flapper and the cross-part of the pocket is smaller than a peripheral clearance between the extending-part of the flapper and an extending-part of the pocket. Thereby, the peripheral fit of the cross-part of the flapper in the cross-part of the pocket holds the extending-part of the flapper angularly located in the extending-part of the pocket so that edges of the flapper do not bind against sidewalls of the extending-part of the pocket, which may otherwise interfere with the opening and closing of the flapper.

In another useful aspect, the pocket is further defined by a dirt trap groove which extends laterally across the extending-part of the pocket. The dirt trap groove traps dirt which may otherwise become entrapped or wedged between the flapper and the valve plate and interfere with the opening and closing of the flapper. Preferably, the dirt trap groove is located adjacent to a hinge line of the valve flapper so as to trap dirt before it becomes wedged between the flapper and the valve plate and to provide for the possibility of blowing dirt out of the trap in the operation of the compressor or vacuum pump. Also, if an adhesive is used for temporary holding of a valve in assembly, the dirt trap groove provides a surface discontinuity to prevent the adhesive wicking past the groove from the clamped area of the valve.

In an especially preferred aspect, the flapper is on a working chamber side of the valve plate so that it acts as an intake valve. Since it is flush with the surrounding surfaces of the valve plate and has no protruding fasteners, the piston in the working chamber can come up very close to the flush surfaces of the flapper and valve plate, thereby minimizing the clearance volume in the working chamber and improving the efficiency of the compressor or vacuum pump.

In another aspect, when the flapper is provided between the valve plate and the head, a ramping surface is preferably formed on the head opposite from the flapper to limit the opening of the flapper, so as to lower the bending stresses at the hinge point of the flapper and improve valve efficiency.

These and other objects and advantages of the invention will be apparent from the detailed description and from the drawings.

BRIEF DESCRIPTION OF THE DRAWINGS

FIG. 1 is a top exploded perspective view illustrating a cylinder and head assembly incorporating reed valves of the invention;

FIG. 2 is a bottom exploded perspective view of the assembly of FIG. 1;

DETAILED DESCRIPTION OF THE PREFERRED EMBODIMENTS

Figure 4:
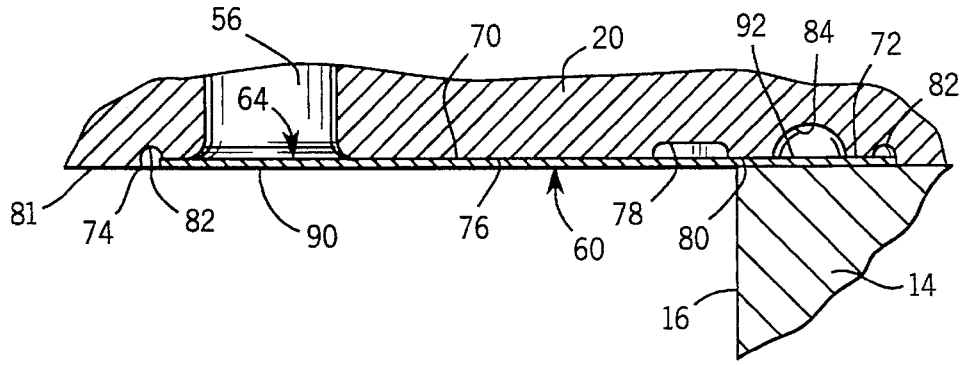
FIG. 4 is a detail view of the intake reed valve of FIG. 3.

FIG. 1 illustrates a cylinder assembly 10 which incorporates a reed valve of the invention. The cylinder assembly 10 includes a cylinder 14 having a bore 16 in which a piston (FIG. 3) 18, such as a wobble type piston, is reciprocated. A valve plate 20 is clamped between cylinder 14 and head 22 by bolts 24. An O-ring seal 26 is received in a seal groove 28 which is formed in the top surface of the cylinder 14 around the bore 16 and establishes an air-tight seal against the working chamber side surface 30 of the valve plate 20. A seal 32 having a circular part 32A and an integral transverse leg 32B is received in a similarly shaped seal groove 34 formed in the head side surface 36 of the valve plate 20 to form an air-tight seal against the head 22.

The transverse leg 32B of seal 32 divides the area of valve plate 20 on head side 36 into an inlet area 40 on one side (the left side as viewed in FIG. 1) of the transverse leg 32B and an exhaust area 42 on the other side (the right side as viewed in FIG. 1) of the transverse leg 32B. Referring to FIG. 2, an inlet chamber 44 is formed in the head 22 above the inlet area 40 and an exhaust chamber 46 is formed in the head 22 above the exhaust area 42, with the transverse part 32B forming a seal against the bottom of wall 48 of head 22, which separates the inlet chamber 44 from the exhaust chamber 46. An exhaust fitting hole 50 is formed in the end of head 22 adjacent to exhaust chamber 46 and communicates with the exhaust chamber 46 and an inlet fitting hole 52 is formed in the opposite end of the head 22 and communicates with the inlet chamber 44.

An exhaust port 54 is formed in the valve plate 20 in the exhaust area 42 and an inlet port 56 is formed in the valve plate 20 in the inlet area 40. Each port 54 and 56 is formed inside of an associated T-shaped valve pocket 58 and 60, respectively. An associated T-shaped valve flapper 62 and 64, respectively, is received in the pockets 58 and 60 to open or close the associated ports 54 and 56 in response to pressure differences across the flappers 62 and 64. It should be noted that the exhaust valve pocket 58 is on the head side 36 of valve plate 20 and that the intake valve pocket 60 and associated flapper 64 are on the working chamber side 30 of the valve plate 20.

Figure 7:
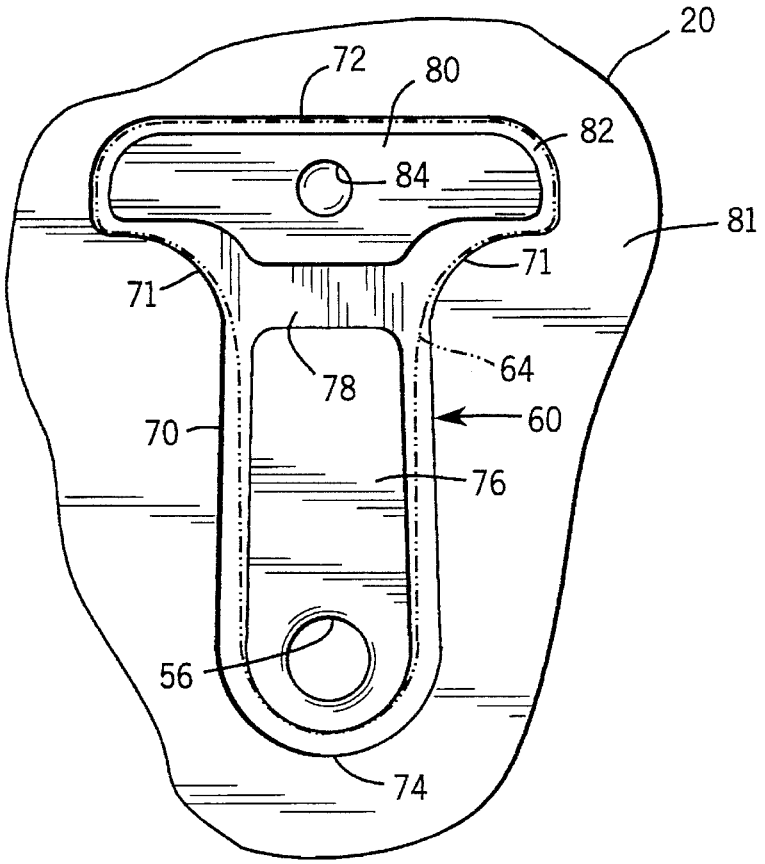
FIG. 7 is a detail plan view of an intake valve pocket for a reed valve of the invention, with a valve flapper drawn in phantom lines.

Referring particularly to FIGS. 4 and 7, the intake valve pocket 60 is illustrated in detail. As illustrated in FIG. 7, the pocket 60, which has the same general shape as the pocket 58, has an extending-part 70 at the column of the T-shape and a cross-part 72 at the top of the T-shape. The inlet port 56 is formed adjacent to the free end 74 of the extending-part 70 and is formed inside of the peripheral edges of a land 76 which forms a valve seat against which the flapper 64 can seal. Land 76 extends around port 56 and toward cross-part 72. A transverse dirt trap groove 78 extends transversely across extending-part 70 at the cross-part end of land 76. Another land 80 is adjacent to the dirt trap groove 78 and substantially fills the cross-part 72, except for a peripheral corner relief groove 82 which surrounds the lands 76 and 80 and the dirt trap groove 78. The relief groove 82 prevents the flapper 64 from catching or binding on corner radii at the bottom of the pocket 60 which may otherwise interfere with the operation of the flapper 64.

The dirt trap groove 78 and the peripheral corner relief groove 82 are approximately the same depth, which is greater than the depth of the lands 76 and 80, and the lands 76 and 80 are also at approximately the same depth. Nominally, the lands 76 and 80 are at a depth equal to the thickness of the flapper 64 below the surface 81 of the valve plate 20 which surrounds pocket 60. For a typical flapper, this depth and the thickness of the flapper may be nominally 0.005 inches. Preferably, the flappers are made of a suitable steel for making valve flappers, typically a stainless spring steel or a stainless steel specifically made for making flapper valves. Such materials are well known in the art.

Figure 8:
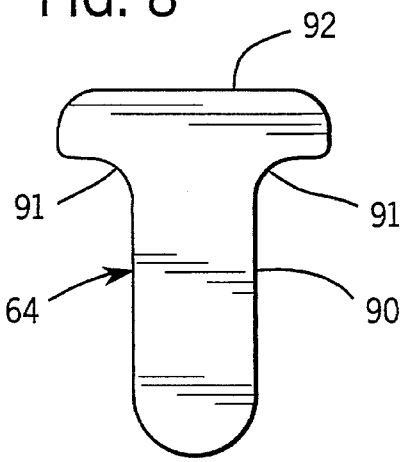
FIG. 8 is a plan view of a valve flapper for a reed valve of the invention.

Referring to FIG. 8, the flapper 64, which is identical to the flapper 62, has an extending-part 90 joined by radiused shoulders 91 to and extending integrally from its cross-part 92. The peripheral dimensions of the flapper 64 are sized so as to fit with a small clearance within the periphery of the pocket 60, so that it can flap freely in the pocket. The cross-part 92 of the flapper 64 fitting in the cross-part 72 of the pocket 60 prevents the flapper from moving longitudinally (along the axis of the extending-part 70) and also keeps the flapper angularly located within the pocket 60. The extending-part 70 of the pocket 60 widens toward its free end 74, starting from the cross-part end of the radiused shoulders 71 at the junction between the cross-part 72 and the extending-part 70, so as to avoid interference with the opening and closing motion of the flapper 64, since slight skewing of the flapper 64 in the pocket 60 becomes amplified toward the free end 74. Thus, the peripheral clearance between the cross-part 92 of the flapper and the cross-part 72 of the pocket is smaller than the peripheral clearance between the extending-part 90 of the flapper and the extending-part 70 of the pocket, so that the fit of the cross-parts 92 and 72 keeps the flapper angularly located in the pocket so that the edges of the extending-part 90 of the flapper do not bind or scrape against the sidewalls of the extending-part 70 of the pocket.

Preferably, the flapper 64 is axially fit within the pocket 60 with a small clamping load exerted between the cylinder 14 and land 80 on its cross-part 92, or with a small clearance between its cross-part 92 and the land 80 and cylinder 14. Too great of a clamping load runs the risk of deforming the valve plate 20 or head 22, which may result in a poor seal, and too much clearance may allow excessive axial skewing of the flapper in the pocket and, for the intake valve, undesirable clearance volume in the working chamber 16.

The depth of the dirt trap groove 78 and the relief groove 82 below the lands 76 and 80 may be nominally 0.010 inches. In addition, a depression 84 may optionally be formed in the land 80 in which a drop of adhesive may be placed for temporarily securing the flapper 64 in the pocket 60 during the assembly process, before the flapper 64 is entrapped in the pocket 60 between the valve plate 20 and the cylinder 14.

Figure 3:
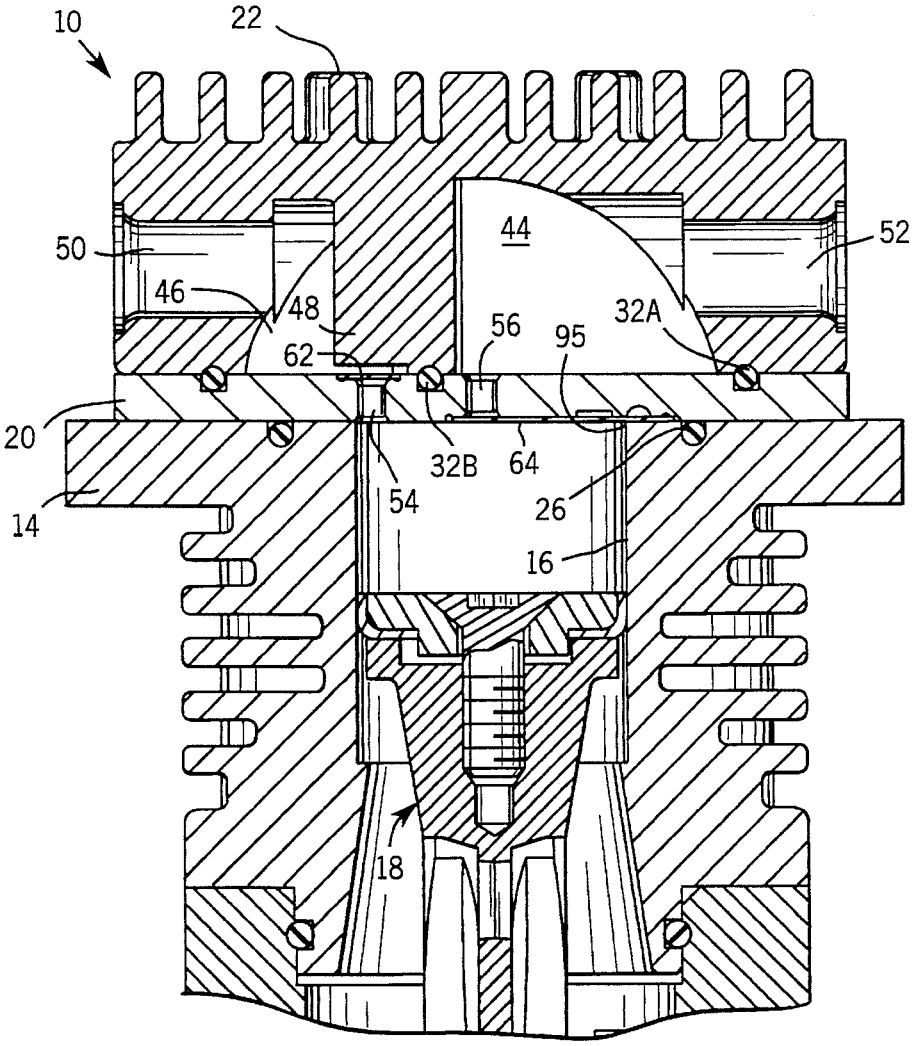
FIG. 3 is a sectional view of the assembly of FIGS. 1 and 2 through the longitudinal extent of the intake reed valve and further illustrating a portion of a wobble piston.

As best shown in FIGS. 3 and 4, the dirt trap groove 78 in the intake valve pocket 60 is located adjacent to the hinge point of the flapper 64, which is defined by the edge 95 of bore 16 underneath the flapper 64. The purpose of the dirt trap groove 78 is to trap small particles which may otherwise wedge themselves between the flapper and the land 76 or the land 80. By positioning the dirt trap groove 78 adjacent to the hinge point, particles will be trapped before they migrate into the hinge point area of the flapper between the valve plate 20 and the cylinder 14. By providing the groove 78 adjacent to the hinge point, particles trapped by the dirt trap 78 can be blown out of the dirt trap 78 when the flapper 64 opens. Also, the groove 78 provides a surface discontinuity to block any adhesive drop (described above) from wicking past the hinge point.

The flapper 62 and associated pocket 58 are identical to the flapper 64 and pocket 60, except for their orientation and location, and the position of the dirt trap groove 78. Accordingly, corresponding reference numerals are used to describe corresponding parts of the flappers 62 and 64 and the pockets 58 and 60.

Figure 6:
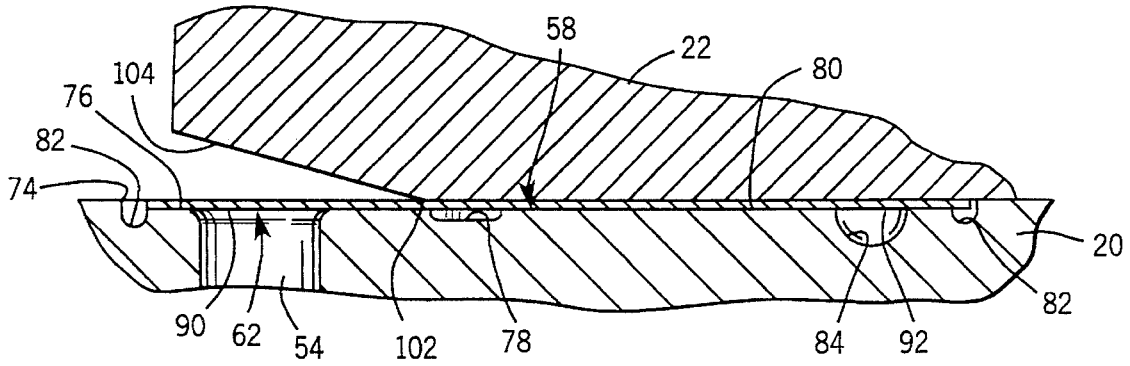
FIG. 6 is a detail view of the exhaust reed valve of FIG. 5.
Figure 5:
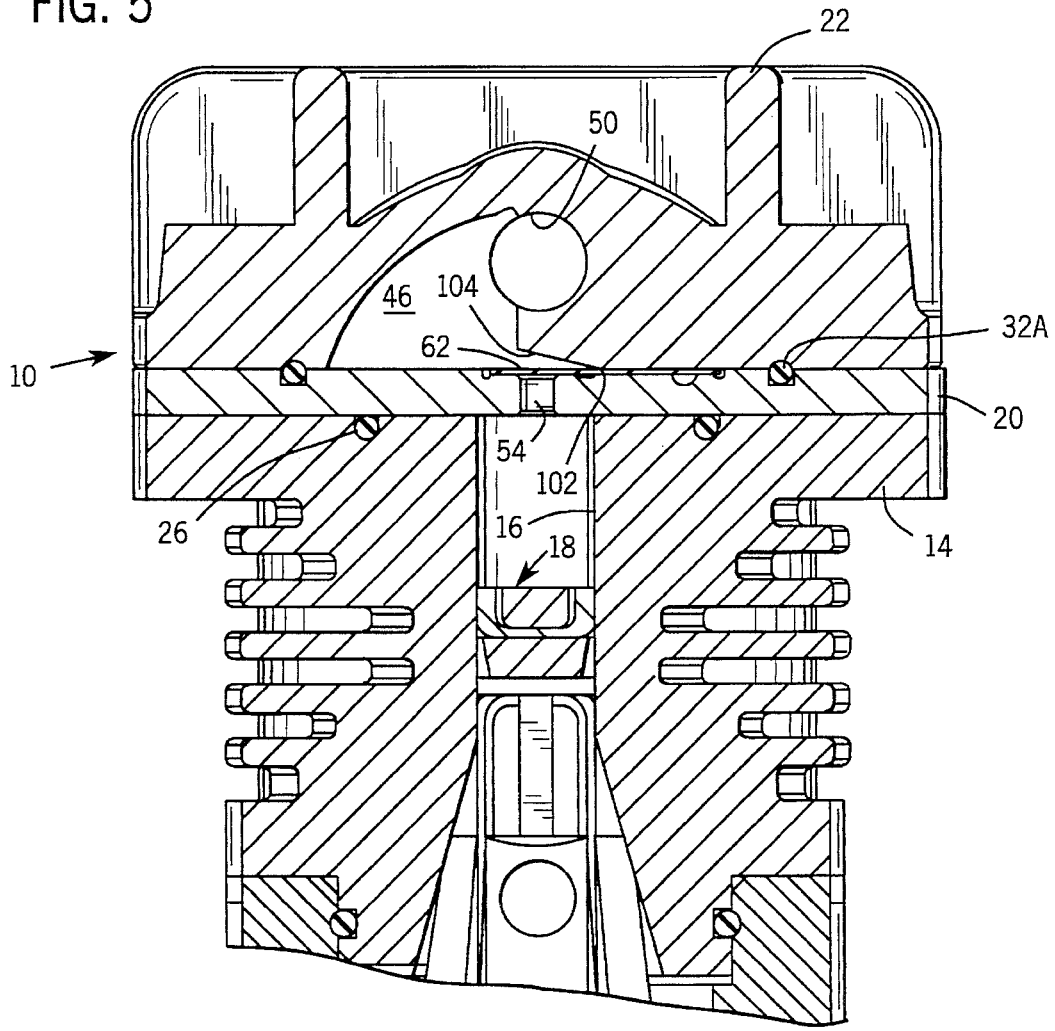
FIG. 5 is a sectional view similar to FIG. 3 but through the longitudinal extent of the exhaust reed valve, which is 90° to the plane of FIG. 3.

The orientation and location of the flapper 62 and pocket 58 are illustrated in FIGS. 1–6 and are described above. The location of the dirt trap groove 78 of the exhaust pocket 58 is illustrated in FIG. 6. As for the intake pocket 60, the dirt trap 78 in the exhaust pocket 58 is adjacent to the hinge point, which is defined by line 102 (FIG. 2) of the head 22. A surface 104 slopes outwardly from line 102 and acts as a stop to limit the opening of flapper 62.

As can be seen in FIG. 4, the intake flapper 64 (when closed) is flush with or slightly below the surrounding surface 81 of the pocket 60. As such, the piston can come up very close at top dead center to touching the valve plate 20, thereby minimizing the clearance volume and maximizing the swept volume within the cylinder 14, so as to increase the pumping efficiency of the unit. In addition, neither of the flappers 62 or 64 require any separate fasteners, since they are trapped in their corresponding pockets 58 and 60 between the valve plate and the cylinder 14 in the case of the flapper 64 or the head 22 in the case of the flapper 62.

Preferred embodiments of the invention have been described in considerable detail. Many modifications and variations to the preferred embodiments will be apparent to those skilled in the art. Therefore, the invention should not be limited to the embodiments described but should be defined by the claims which follow.

I claim:

1. In a reed valve for a compressor or vacuum pump of the type which has a valve flapper that opens or closes over a port in a valve plate in response to a pressure difference across it, the improvement wherein said valve flapper is generally T-shaped, having a cross-part and an extending-part extending from said cross-part, and said valve flapper is received in a similarly T-shaped recessed valve pocket having a cross-part and an extending-part extending from said cross-part and surrounding said port, said flapper being received in said pocket with said cross-part of said flapper within said cross-part of said pocket and said extending-part of said flapper within said extending part of said pocket and extending over said port, and wherein said cross-part of said flapper is captured in said cross-part of said pocket between said valve plate and another component of said pump to which said valve plate is attached and said flapper has an outer surface which is substantially flush with surfaces of said valve plate surrounding said pocket.

2. The improvement of claim 1, wherein said other component is a head or a cylinder of said pump.

3. The improvement of claim 1, wherein said pocket is further defined by a peripheral corner relief groove which extends around the inside of said pocket at a bottom surface thereof so that said flapper is supported on one or more lands above said groove.

4. The improvement of claim 1, wherein said pocket is further defined by a dirt trap groove which extends laterally across said extending-part of said pocket.

5. The improvement of claim 4, wherein said dirt trap groove is located adjacent to a hinge line of said valve flapper.

6. The improvement of claim 1, wherein said flapper is on a working chamber side of said valve plate and a surface of said flapper facing toward said working chamber is substantially flush with a surface of said valve plate which surrounds said pocket.

7. The improvement of claim 1, wherein said extending-part of said pocket widens in the direction away from said cross-part.

8. The improvement of claim 1, wherein a peripheral clearance between said cross-part of said flapper and said cross-part of said pocket is smaller than a peripheral clearance between said extending-part of said flapper and an extending-part of said pocket, so that the peripheral fit of the cross-part of said flapper in said cross-part of said pocket holds said extending-part of said flapper angularly located in said extending-part of said pocket so that edges of said extending-part of said flapper do not bind against sidewalls of said extending-part of said pocket.

9. The improvement of claim 1, wherein said other component is a head of the compressor or vacuum pump, and a ramping surface is formed on said head opposite from said flapper, said ramping surface limiting the opening of said flapper.

* * * * *